US007845401B2

(12) United States Patent
Wildman et al.

(10) Patent No.: US 7,845,401 B2
(45) Date of Patent: Dec. 7, 2010

(54) TELESCOPING WIPER PLUG

(75) Inventors: Samuel L. Wildman, Kingwood, TX (US); Jack David Farmer, Dickenson, TX (US)

(73) Assignee: Baker Hughes Incorporated, Houston, TX (US)

( * ) Notice: Subject to any disclaimer, the term of this patent is extended or adjusted under 35 U.S.C. 154(b) by 214 days.

(21) Appl. No.: 12/056,654

(22) Filed: Mar. 27, 2008

(65) Prior Publication Data

US 2009/0242191 A1 Oct. 1, 2009

(51) Int. Cl.
*E21B 33/08* (2006.01)

(52) U.S. Cl. ..... 166/177.3; 15/104.062

(58) Field of Classification Search ..... 166/170–177.3, 166/242.7; 15/104.03–104.33
See application file for complete search history.

(56) References Cited

U.S. PATENT DOCUMENTS

| | | | | |
|---|---|---|---|---|
| 2,601,614 | A * | 6/1952 | Johnson | 15/104.061 |
| 2,893,493 | A * | 7/1959 | Copas | 166/170 |
| 3,007,525 | A * | 11/1961 | Orr | 166/170 |
| 3,036,635 | A * | 5/1962 | Corley, Jr et al. | 166/67 |
| 4,624,312 | A | 11/1986 | McMullin | |
| 5,722,491 | A | 3/1998 | Sullaway et al. | |
| 6,513,590 | B2 | 2/2003 | Allamon et al. | |
| 6,799,638 | B2 * | 10/2004 | Butterfield, Jr. | 166/386 |
| 7,096,949 | B2 * | 8/2006 | Weber et al. | 166/291 |
| 7,325,617 | B2 | 2/2008 | Murray | |
| 7,395,856 | B2 | 7/2008 | Murray | |
| 7,481,461 | B2 * | 1/2009 | McGarian et al. | 285/145.1 |
| 7,487,832 | B2 * | 2/2009 | Read, Jr. | 166/297 |
| 7,552,779 | B2 | 6/2009 | Murray | |
| 2002/0000318 | A1 | 1/2002 | Allamon et al. | |
| 2003/0164237 | A1 | 9/2003 | Butterfield, Jr. | |

OTHER PUBLICATIONS

Plante, Mark E., et al., "Advantages to Remedial Operations of Coiled-Tubing-Enables Under-balanced Removal of Latest-Generation Composite Bridge Plugs", SPE 60718, Apr. 2000, 1-15.
Imhoff, Jamie, et al., "Composites Improve Well Construction Efficiency", SPE 125084, Oct. 2009, 1-12.
Sankar, Regan, et al., "Challenging the Limits: Setting Long Cement Plugs", SPE 81182, Apr. 2003, 1-11.

* cited by examiner

*Primary Examiner*—David J Bagnell
*Assistant Examiner*—Kipp C Wallace
(74) *Attorney, Agent, or Firm*—Steve Rosenblatt

(57) ABSTRACT

A wiper plug has a telescoping feature to allow it to be shorter while in a lubricator so as to reduce lubricator length as compared to an extended length for proper propulsion past off center openings such as side pocket mandrels in the string. The wiper has a telescoping feature that allows it to extend when dropping or being pumped from a lubricator. Once extended, it can lock in the extended position so that it doesn't collapse on the way down the string. Centralizers can optionally be used between an upper and a lower wiping section.

15 Claims, 2 Drawing Sheets

TELESCOPING WIPER PLUG

FIELD OF THE INVENTION

The field of the invention is wiper plugs that clean residual cement from inside tubular strings and more particularly wiper plugs that can operate in non-concentric components of strings such as side pocket mandrels.

BACKGROUND OF THE INVENTION

Wiper plugs are used to displace cement from a tubular string that has just had cement pumped through its lower end and into a surrounding annular space to seal it. Typically, a cement shoe keeps the pumped cement from coming back from the annulus into the string through which it was delivered. Some systems deliver a wiper plug as a spacer before the cement is delivered and another wiper to go behind the cement. Wiper plugs generally comprise of a series of cone shaped structures parallel to each other generally made of a resilient material. They are held above a wellhead in an enclosure called a lubricator which in essence is a long tubular with valves near opposed ends. The lubricator allows the well to be isolated to load the wiper plug or plugs and then the loading valve to be closed and the drop valve to be opened to release the wiper plug into the wellbore string. The string generally has a sub for catching the wiper plug called a landing collar.

Some strings have off center components such as a side pocket mandrel. When such devices are in the wellbore the wiper plugs are made longer than normal so that they can straddle the side opening with wiper assemblies so that their downward momentum is not lost at the side opening. Typically the side opening is longer than the length of the wipers on a typical wiper plug. The solution to this problem in the past has been to make significantly longer wiper plugs with two spaced apart assemblies so that as the lower wiper assembly aligns with the opening to the side pocket, the upper wiper assembly is still above and can be driven down with pressure from the surface. Subsequently, when the upper wiper assembly is at the entrance to the side pocket, the lower wiper assembly has cleared the entrance to the side pocket and pressure from the well surface can act on the lower wiper assembly to continue the movement of the wiper plug to the landing collar.

Providing such extended wiper plug assemblies has resulted in having to make the lubricator longer to accommodate them. This has created problems in certain installations because of space available has been limited and access to the top of longer lubricators has also been limited. Further there is the issue of providing adequate bracing to a very long and slender structure that is stood on end in normal service.

The present invention addresses this issue by providing a telescoping wiper plug that can be installed in a lubricator of a reasonable length and when launched is able to extend in length so that it can be properly propelled beyond offsets in a string such as a side pocket mandrel. These and other aspects of the present invention will be more readily apparent to those skilled in the art from a review of the description of the preferred embodiment which appears below with the associated drawings while recognizing that the scope of the invention is determined by the claims.

SUMMARY OF THE INVENTION

A wiper plug has a telescoping feature to allow it to be shorter while in a lubricator so as to reduce lubricator length as compared to an extended length for proper propulsion past off center openings such as side pocket mandrels in the string. The wiper has a telescoping feature that allows it to extend when dropping or being pumped from a lubricator. Once extended, it can lock in the extended position so that it doesn't collapse on the way down the string. Centralizers can optionally be used between an upper and a lower wiping section.

DETAILED DESCRIPTION OF THE PREFERRED EMBODIMENT

Figure 1:
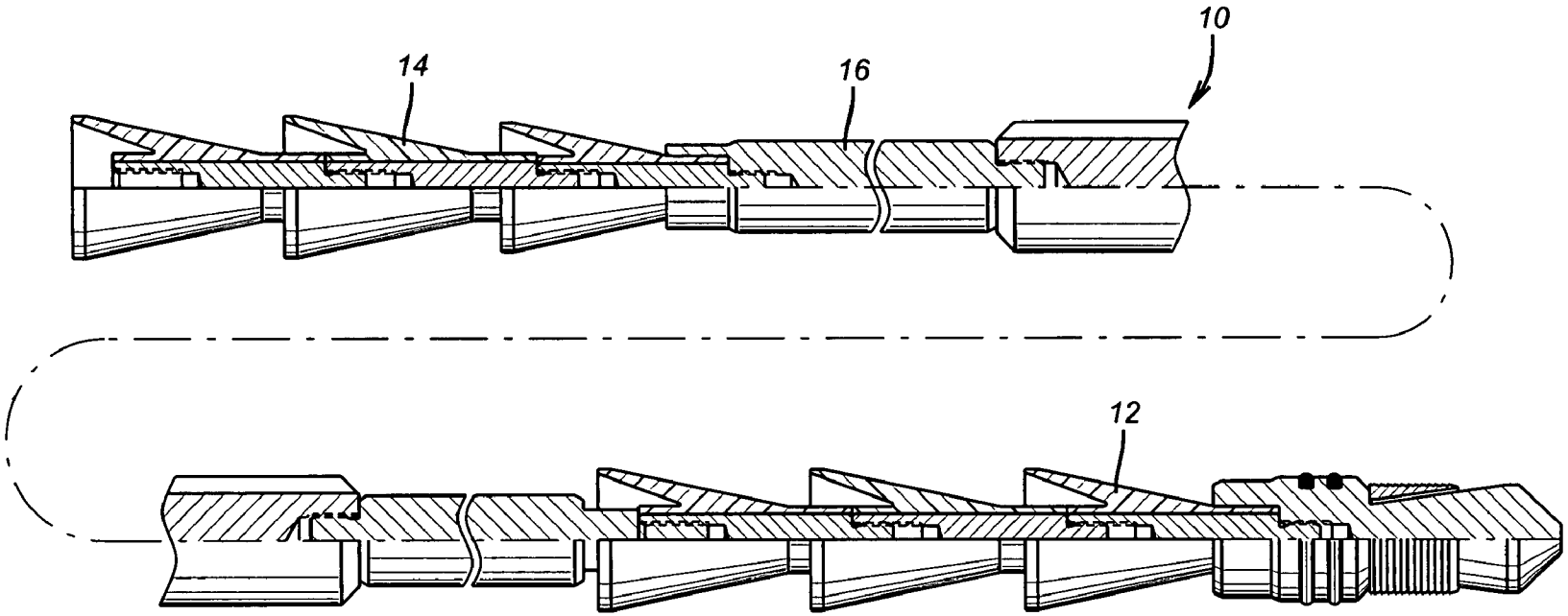
(PRIOR ART) FIG. 1
FIG. 1 is a prior art design of a fixed length wiper plug with disparate wiper sections.

FIG. 1 illustrates the existing fixed length wiper plug 10 that has a leading wiper section 12 and a trailing wiper section 14 separated by a shank 16 that has a fixed length. The length of 16 is determined by the spacing needed to separate the wiper sections so that section 14 will be above the opening for a side pocket mandrel or other offset opening in the string when the lower section 12 is at that opening. Any pressure applied to the wiper plug 10 from above will then keep it moving past the opening in the string. By the time the trailing section 14 gets to the opening in the string, the leading section will be beyond the opening and pressure from above will act on wiper section 12 to keep the wiper plug 10 moving. The problem with this design is that the fixed length to get the needed spacing between 12 and 14 requires that a lubricator that holds the wiper plug 10 to be even longer and in some applications that additional space is not available or it makes supporting the lubricator and operating its controls to be unwieldy or even unworkable.

Figure 2:
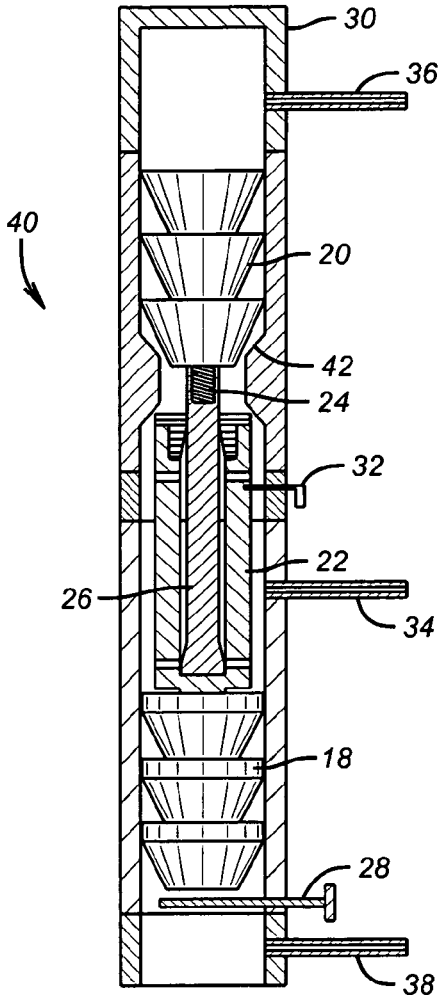
FIG. 2 is the telescoping wiper plug shown in the ready to drop position.

The present invention is shown in FIG. 2. The lower wiper assembly 18 is connected to a housing 22. The upper wiper 20 is connected to shaft 24 that fits in recess 26 of housing 22. A release device 28 supports the lower wiper assembly 18 in the telescoped shorter length position for insertion into the lubricator 30. A flag signal of a type known in the art indicated whether or not a wiper plug has been launched. Apart from operating the release 28, fluid pressure can be provided at connection 34 or optionally at connection 36 higher up. A cement line 38 allows pumping cement ahead of the wiper plug assembly 40. A shoulder 42 can lend support to the upper wiper assembly 20 when support is undermined by operating the plug release 28. A locking sub 44 (FIG. 3) is schematically illustrated. It locks the shaft 24 extended from the housing 22.

Figure 3:
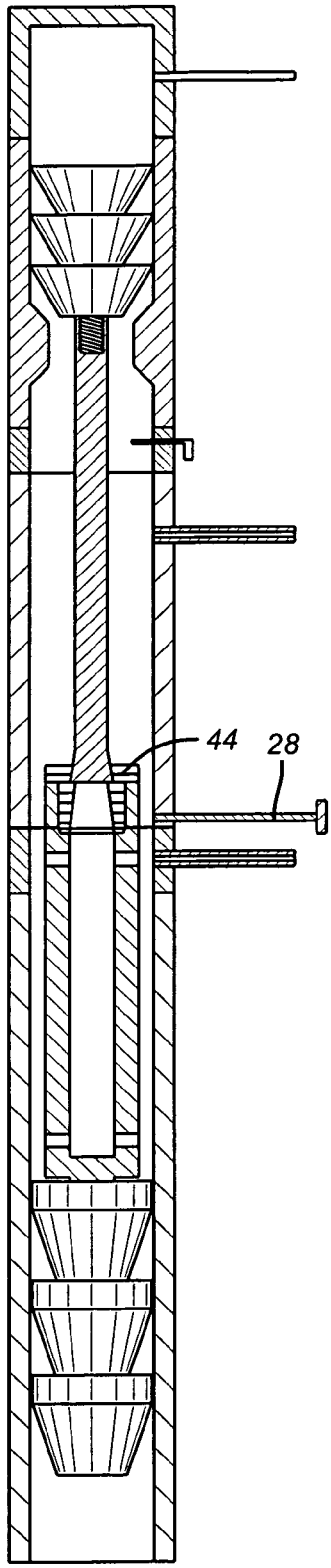
FIG. 3 is the extended position and ready to go down the tubing string.

FIG. 3 shows the plug release 28 operated so it no longer supports the plug assembly 40. At that time the weight of the housing 22 and wiper assembly 18 may be enough to extend housing 22 with respect to a still supported upper wiper assembly 20 that now rests on shoulder 42. Alternatively or additionally, pressure can be applied at connection 34 to result in getting the FIG. 3 extended position, again with upper wiper assembly still supported off of shoulder 42. Once full extension is reached locking sub 44 keeps the parts 22 and 24 together and against separation while preventing a collapse back to the telescoped short position of FIG. 2.

Those skilled in the art will appreciate that the amount of telescoping before locking in position can be varied so that a single assembly 40 can serve a variety of applications with different requirements for spacing between a pair of wiper assemblies. While two wiper assemblies are illustrated, the invention contemplates more than two wiper assemblies with identical or differing extensions as required by the application. The length of extension can be controlled by travel stops while the locking against collapse can be done with snap rings that jump into a groove or using a one way ratchet all schematically addressed by 44.

With the design presented a shorter assembly can be used initially in a shorter lubricator and the assembly can extend as it is released from the lubricator so that it will have the needed greater spacing to function at side pocket mandrels or other openings in the strings without forcing the need to make a lubricator as long as the extended length of the assembly 40.

The above description is illustrative of the preferred embodiment and many modifications may be made by those skilled in the art without departing from the invention whose scope is to be determined from the literal and equivalent scope of the claims below.

We claim:

1. A wiper plug assembly for downhole use, comprising:

at least two wiper sections that are separated from each other by a shaft assembly having opposed ends between said wiper sections, the length of said shaft assembly between said opposed ends telescopes so that said shaft assembly can only extend when a support for at least one wiper section is removed for subsequent travel downhole exclusively in the extended position.

2. The assembly of claim 1, wherein:

said wiper sections are prevented from separating when extending relative to each other.

3. The assembly of claim 2, wherein:

said wiper sections are prevented from collapsing after extending relative to each other.

4. The assembly of claim 1, wherein:

said wiper sections selectively telescope longer due to the weight of said wiper sections.

5. The assembly of claim 1, wherein:

said wiper sections telescope longer in response to an applied force.

6. The assembly of claim 1, wherein:

wherein the amount of shaft extension possible can be preset at different lengths.

7. The assembly of claim 1, wherein:

said at least two wiper sections comprises more than two wiper sections separated by a plurality of shafts, the length of said shafts are variable.

8. The assembly of claim 7, wherein:

the amount of length extension between wiper sections is identical.

9. The assembly of claim 7, wherein:

the amount of length extension between wiper sections is different.

10. A wiper plug assembly for downhole use, comprising:

at least two wiper sections that are separated from each other by a shaft assembly, the length of said shaft assembly is variable so that said shaft assembly can only extend when support for at least one wiper section is removed for subsequent travel downhole exclusively in the extended position;

said shaft assembly comprises telescoping components;

said components are prevented from separating when extending relative to each other;

said components are prevented from collapsing after extending relative to each other;

said components lock in an extended position with a snap ring.

11. A wiper plug assembly for downhole use, comprising:

at least two wiper sections that are separated from each other by a shaft assembly, the length of said shaft assembly is variable so that said shaft assembly can only extend when support for at least one wiper section is removed for subsequent travel downhole exclusively in the extended position;

said shaft assembly comprises telescoping components;

said components are prevented from separating when extending relative to each other;

said components are prevented from collapsing after extending relative to each other; said components lock in an extended position with a ratchet.

12. A wiper plug assembly for downhole use, comprising:

at least two wiper sections that are separated from each other by a shaft assembly, the length of said shaft assembly is variable so that said shaft assembly can only extend when a support for at least one wiper section is removed for subsequent travel downhole exclusively in the extended position;

a lubricator that is longer than said shaft and wiper sections when telescoped short and shorter than the length of said shaft and wiper sections when telescoped long;

a said support in said lubricator located below both wiper sections, said shaft telescoping longer when said removable support is removed.

13. A wiper plug assembly for downhole use, comprising:

at least two wiper sections that are separated from each other by a shaft assembly, the length of said shaft is variable;

a lubricator that is longer than said shaft and wiper sections when telescoped short and shorter than the length of said shaft and wiper sections when telescoped long;

a removable support in said lubricator located below both wiper sections, said shaft telescoping longer when said removable support is removed;

an upper support in said lubricator to engage between said wiper sections, whereupon removal of said removable support said upper support holds a wiper section to allow the weight of the other wiper section extend the length of said shaft.

14. The assembly of claim 13, wherein:

said lubricator comprises a first connection to allow fluid pressure to be admitted between said wiper sections.

15. The assembly of claim 14, wherein:

said lubricator comprises a second connection to allow fluid pressure to be admitted above two wiper sections.

* * * * *